US005993176A

United States Patent [19]

Kingsford et al.

[11] Patent Number: 5,993,176

[45] Date of Patent: Nov. 30, 1999

[54] MAGNETICALLY-DRIVEN CENTRIFUGAL PUMP

[75] Inventors: Kenji A. Kingsford, Devore; Hy Ba Nguyen, Upland, both of Calif.

[73] Assignee: Furon Company, Laguna Niguel, Calif.

[21] Appl. No.: 08/885,746

[22] Filed: Jun. 30, 1997

[51] Int. Cl.[6] ..... F04B 17/00

[52] U.S. Cl. ..... 417/420; 417/423.14; 415/173.2; 415/174.1

[58] Field of Search ..... 417/420, 423.14; 415/173.2, 174.1, 126, 128

[56] References Cited

U.S. PATENT DOCUMENTS

| | | | |
|---|---|---|---|
| 4,013,384 | 3/1977 | Oikawa | 417/368 |
| 4,722,661 | 2/1988 | Mizuno | 415/131 |
| 4,828,454 | 5/1989 | Morris et al. | 415/48 |
| 5,169,286 | 12/1992 | Yamada | 415/48 |
| 5,211,530 | 5/1993 | Shiffler | 415/48 |
| 5,334,004 | 8/1994 | Lefevre et al. | 417/420 |
| 5,525,039 | 6/1996 | Sieghartner | 417/423.14 |

FOREIGN PATENT DOCUMENTS

| | | | |
|---|---|---|---|
| 391287 | 7/1973 | Russian Federation | 415/173.2 |
| 0714833 | 4/1984 | U.S.S.R. | 415/174.1 |

*Primary Examiner*—Charles G. Freay
*Attorney, Agent, or Firm*—Christie, Parker & Hale, LLP

[57] ABSTRACT

A magnetically-driven centrifugal pump comprises a pump body having a pump chamber extending therein from a pump body open end to a pump body closed end, and includes a liquid inlet port and a liquid outlet port for accommodating passage of liquid to and from the pump chamber. An outer magnet assembly is disposed concentrically around the pump chamber and attached to a drive means. An inner magnet assembly is disposed within the pump chamber and is mounted to a shaft that is rotatably mounted within the pump chamber. An impeller is attached to the inner magnet assembly and is mounted to the shaft. Together, the shaft, inner magnet assembly and impeller are rotated within the pump chamber by magnetically coupling with the outer magnet assembly. A diaphragm is disposed within the open end of the pump body and is positioned adjacent the impeller. The diaphragm includes a sleeve that extends radially therefrom and is adapted to form a leak-tight seal with the pump body without the use of O-ring seals. The diaphragm sleeve facilitates axial displacement of the diaphragm relative to the pump body to adjust the spatial distance between the impeller and diaphragm to zero tolerance after the pump has been assembled. Such adjustment feature minimizes pressurized liquid bypass from an impeller cavity of the pump, and maximizes pump output pressure and pump efficiency. The pump includes means for axially displacing the diaphragm, and fixing the axial displacement of the diaphragm, to achieve a determined pump output pressure after the pump has been assembled.

25 Claims, 4 Drawing Sheets

MAGNETICALLY-DRIVEN CENTRIFUGAL PUMP

FIELD OF THE INVENTION

This invention relates to magnetically-driven centrifugal pumps that can be used for delivering corrosive liquids and the like under pressure without pump component degradation, and for transporting or delivering chemically pure liquids under pressure without contaminating the liquids; and more specifically, to magnetically-driven centrifugal pumps that are constructed without O-ring seals, and that have an adjustable impeller cavity thereby allowing the best boost or pump output pressure to be fine tuned and optimized after pump assembly.

BACKGROUND OF THE INVENTION

Centrifugal pumps are commonly used to transport or deliver liquids under pressure for applications such as for the transport of as industrial process liquids and the like. The magnetically-driven centrifugal pump is a variant of the centrifugal pump that, instead of having a pump impeller directly attached to a drive shaft, has a separate drive motor and pump rotor. A magnetic coupling between the drive motor and pump rotor is accomplished by arranging a driving magnet concentric to and outside of an annular impeller magnet provided in an impeller. The driving and impeller magnets are magnetically coupled together to transmit rotating torque therebetween, thereby causing the impeller to rotate and effect pressurized transport therefrom.

The advantage of using such a magnetically-coupled or magnetically-drive centrifugal pump design is that it avoids the presence of a drive shaft extending through the pump housing to the pump impeller, thereby avoiding a potential liquid leak path from the pump or impeller cavity. Avoiding such potential leak path is important because it not only minimizes the possibility of a health danger or an environmental hazard in the event of liquid leakage from the pump, but because it also eliminates the potential that the process liquid will be contaminated by contact with the metallic drive shaft element in the event that such liquid leakage occurs.

The desire to avoid liquid leakage and potential process liquid contamination in a pump is especially important in such applications where the liquid being transferred is a high-purity liquid, i.e., process chemicals or water that are used in the semi-conductor manufacturing industry, that must maintain a high degree of chemical purity to avoid contamination that may occur on the microscopic level. Other applications where the need to avoid process liquid contamination include those where the liquid being transported is a chemical medication or liquid meant for human consumption, such as beverages or the like.

Conventional magnetically-driven centrifugal pumps include a pump impeller that is disposed within an impeller cavity of the pump body. The spatial relationship of the pump impeller to the impeller cavity wall is fixed, thereby fixing the tolerance between the impeller and the wall, and fixing the impeller cavity volume. The design of having a fixed tolerance between the impeller and cavity causes the maximum output pressure of the pump to be fixed. In order to obtain a desired maximum pump output pressure it is necessary that the members of the pump be manufactured and assembled within a tight tolerance, and more specifically that the impeller and impeller cavity wall have a zero tolerance fit. Variations in the axial placement of the pump impeller vis-a-vis the cavity wall that are caused either during the manufacturing or assembly stage impact the impeller to cavity wall tolerance, thereby impacting the maximum pump output pressure. Accordingly, it is not uncommon for pumps designed in such manner fashion to have different maximum output pressures.

Additionally, there are applications where small adjustments in the pump output pressure, that are not otherwise achievable by regulating the rotational speed of the drive motor, would be desired. Conventional magnetically-driven centrifugal pumps having a fixed impeller to impeller wall tolerance are not capable of offering a user the option of making such small or finely-tuned pressure adjustments independent of the drive motor.

It is, therefore, desirable that a magnetically-driven centrifugal pump be constructed having means for adjusting the pump output pressure, to achieve maximum output pressure, that operate independent of adjustments made to the drive motor. When transporting high-purity liquids, it is desired that such magnetically-driven centrifugal pump be made in a manner that both: (1) eliminates the possibility that contaminants may be introduced into the process caused by contact of the process liquid with elements of the pump during passage therethrough; and (2) minimizes the number of potential liquid leak paths therethrough, thereby reducing or eliminating the possibility of process liquid escaping from the impeller cavity into other portions of the pump or into the environment. It is desired that such magnetically-driven centrifugal pump have wetted members made from material having a high degree of chemical resistance and/or thermal resistance to resist degradation through contact with corrosive, or caustic chemicals and the like. It is desirable that such magnetically-driven centrifugal pump be capable of operating at high pressures without danger of pump failure or chemical leakage. It is also desirable that such magnetically-driven centrifugal pump be constructed using conventional manufacturing principles from available materials to reduce the cost of manufacturing such pump.

SUMMARY OF THE INVENTION

Magnetically-driven centrifugal pumps, prepared according to principles of this invention, generally comprise a pump body that has a pump chamber extending therein from a pump body open end to a pump body closed end, and that includes a liquid inlet port and a liquid outlet port for accommodating passage of liquid to and from the pump chamber. An outer magnet assembly is disposed concentrically around the pump chamber and attached to a drive means. An inner magnet assembly is disposed within the pump chamber and is mounted to a shaft that is rotatably mounted within the pump chamber. An impeller is attached to the inner magnet assembly and is mounted to the shaft. Together, the shaft, inner magnet assembly and impeller are rotated within the pump chamber by magnetically coupling with the outer magnet assembly.

A diaphragm is disposed within the open end of the pump body and is positioned adjacent the impeller. The diaphragm includes a sleeve that extends radially therefrom and is adapted to form a leak-tight seal with the pump body without the use of O-ring seals. The diaphragm sleeve facilitates axial displacement of the diaphragm relative to the pump body to adjust the tolerance between the impeller and diaphragm after the pump has been assembled, thereby enabling adjustment of the impeller to a zero tolerance fit with an impeller wall to minimize pressurized liquid bypass and maximize pump output pressure and pump efficiency. The pump includes means for axially displacing the diaphragm, and fixing the axial displacement of the diaphragm, to achieve a determined pump output pressure after the pump has been assembled.

In an example embodiment, the pump includes an end flange that is mounted over the diaphragm and that is attached to the pump body open end, and the means for axially displacing the diaphragm is in the form of an axially adjustable spacer that is interposed between the diaphragm and the end flange. The spacer is in contact with the diaphragm and the end flange includes an opening therethrough for accessing the spacer to effect axial displacement of the spacer and diaphragm from a position outside of the assembled pump body.

Magnetically-driven pumps of this invention provide means for adjusting the impeller cavity volume, i.e., adjusting the pump output pressure, independent of the pump driving means. Additionally, pumps of this invention avoid the use of O-ring type seals, thereby eliminating the possibility of introducing O-ring-related contaminates into the process liquid, and eliminating the possibility of O-ring related liquid leakage and pressure loss due to compression set. Pumps of this invention also have wetted members made from fluoropolymeric materials, thereby providing a desired degree of chemical resistance, to enable pump operation in applications where the process liquid is a corrosive, acidic or caustic chemical, and minimizing or eliminating the introduction of contaminant materials into a high-purity process liquid caused by material degradation.

DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE INVENTION

Magnetically-driven centrifugal pumps constructed in accordance with the practice of this invention comprise a pump diaphragm that is axially displaceable within an impeller cavity of the pump to adjust the distance between the vanes of an impeller and a wall of the impeller cavity to zero tolerance after the pump as been assembled. The pump diaphragm thereby provides a means for adjusting the pump output pressure to achieve maximum pump output pressure to achieve maximum pump output pressure independent of the pump driving means. Additionally, the pump diaphragm is adapted to provide a tongue and groove attachment between itself and a pump body to provide a leak-tight seal therebetween without the need for using O-ring seals.

Figure 1:
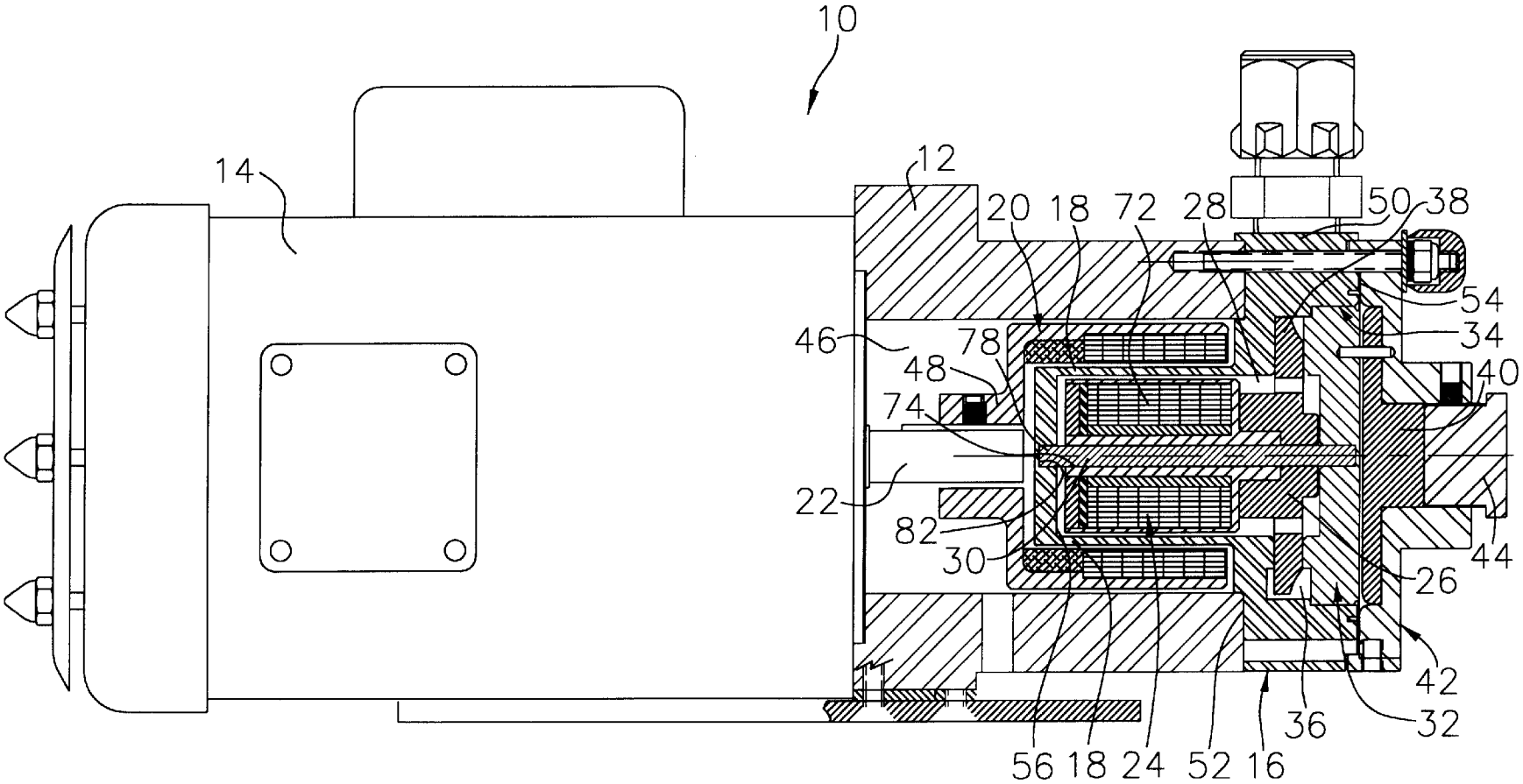
FIG. 1 is a cross-sectional side view of a magnetically-driven centrifugal pump provided in accordance with practice of the present invention.

Referring to FIG. 1, an example embodiment of a magnetically-driven centrifugal pump 10 constructed according to the practice of this invention comprises a pump housing 12 that extends away from an end of a pump drive means 14. A pump body 16 is attached to an end of the pump housing and includes an elongated section 18 that is disposed axially within the pump housing 12. An outer magnet assembly 20 is disposed concentrically around the elongated section 18 and is connected to a drive shaft 22 of the pump drive means 14. An inner magnet assembly 24 and pump impeller 26 are disposed axially within a pump chamber 28 of the pump body that is formed within the elongated section 18. The inner magnet assembly 24 and impeller 26 are mounted on a shaft 30 that is free to rotate within the pump chamber 28. A pump diaphragm 32 is disposed within an open end 34 of the pump body 16 and is positioned adjacent the impeller 26. An impeller cavity 36 is defined within the pump chamber 28 between adjacent pump body 16 and diaphragm 32 surfaces, and impeller vanes 38 are contained therein. An adjustment spacer 40 is disposed adjacent the diaphragm 32, and an end flange 42 is positioned over both the open end 34 of the pump body 16 and the adjustment spacer. An adjustment knob 44 is disposed axially through end flange 42 to permit axial adjustment of the spacer 40 and diaphragm 32 vis-a-vis the pump body, thereby adjusting the volume of the impeller cavity 36.

Figure 2:
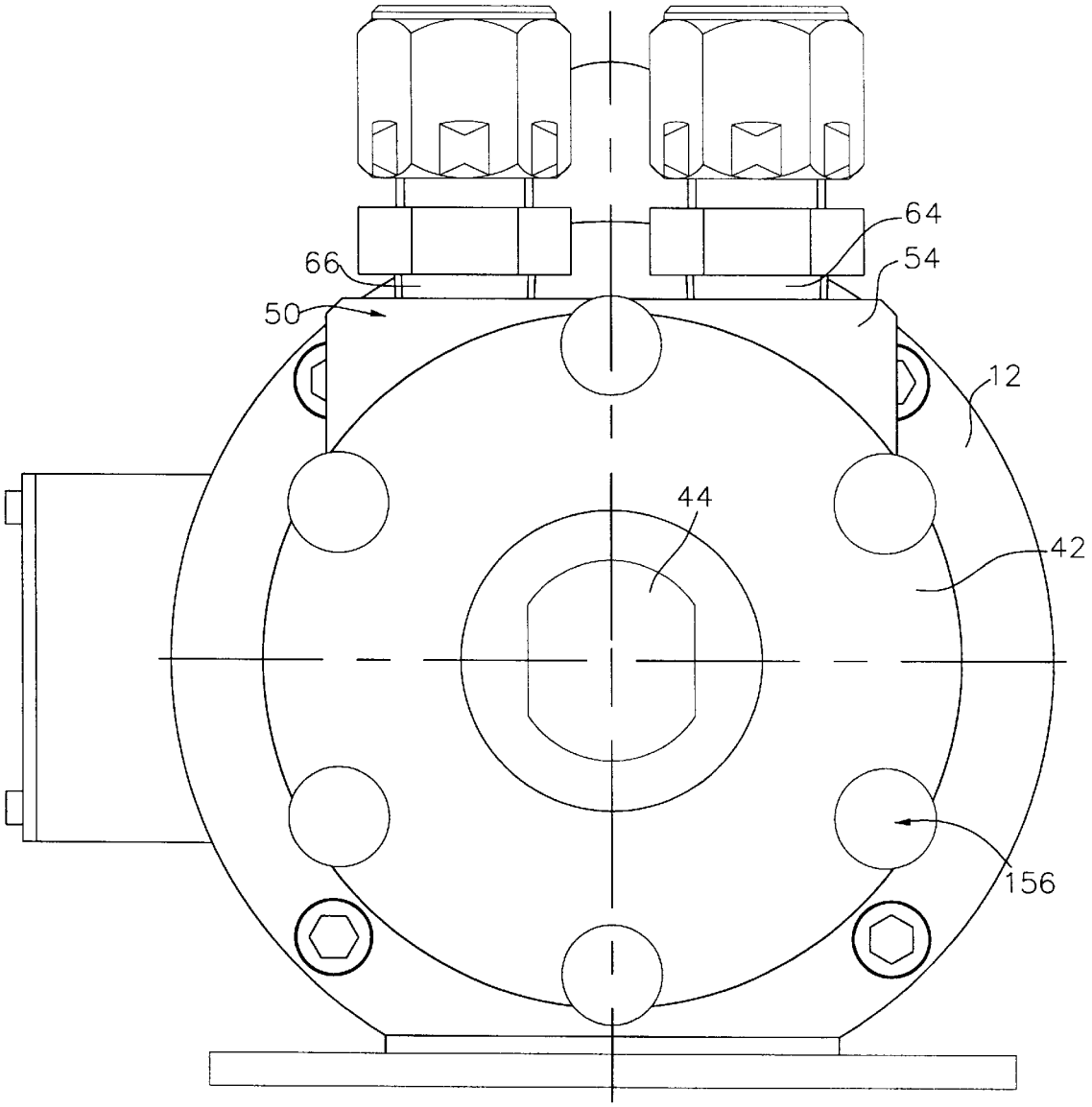
FIG. 2 is an end view of the magnetically-driven centrifugal pump of FIG. 1.
Figure 3:
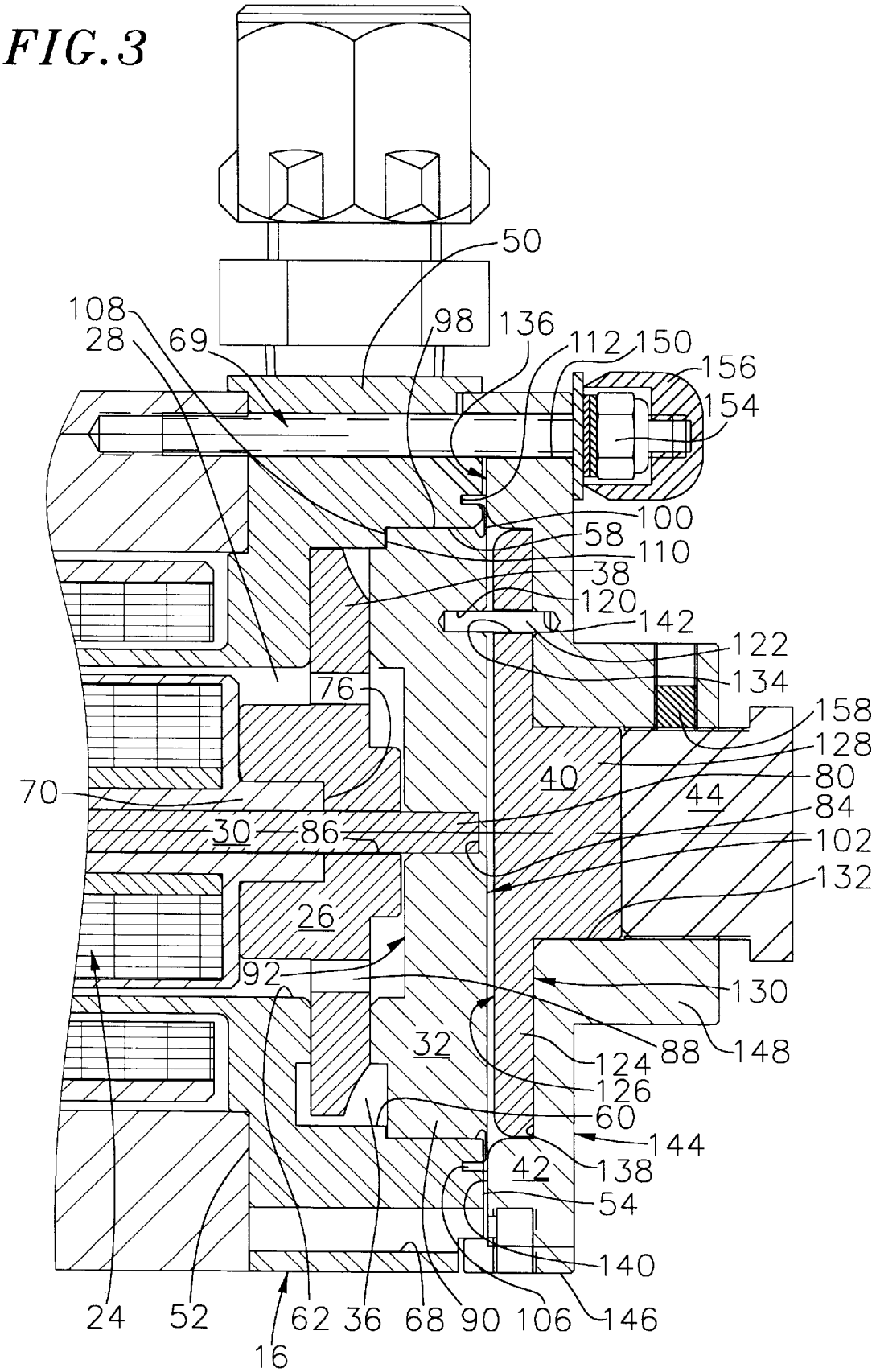
FIG. 3 is an enlarged cross-sectional side view of the magnetically-driven centrifugal pump of FIG. 1.

Referring to FIGS. 1 to 3, the pump housing 12 includes a hollow chamber 46 that is sized to accommodate placement of both the outer magnet assembly 20 and elongated section 18 of the pump body 16 therein. In an example embodiment, the pump housing is cylindrical. The pump body can be made from any suitable structural material, such as metal and metal alloy. In an example embodiment, the pump housing is made from aluminum. The pump housing is attached at one end to the pump drive means 14, which can be any conventional driving means such as an electrical motor and the like. In an example embodiment, the drive means 14 is a ½ horsepower electric motor. The drive shaft 22 from the drive means extends axially a distance into the hollow chamber 46 and is connected to an actuating member 48 by conventional connection means, such as by set screw and the like. The outer magnet assembly 20 is attached or may be integral to the actuating member 48 and has an annular shape that has a diameter sized to both fit within the hollow chamber 46 and fit concentrically around the pump body elongated section 18. The actuating member 48 and outer magnet assembly 20 are rotated within the hollow chamber by activation of the pump drive means and rotation of the drive shaft 22.

The pump body 16 is attached to an opposite end of the pump housing. The pump body is a one-piece construction that defines the pump chamber 28 therein. The pump chamber is designed both to accommodate the inner magnet assembly 24 and impeller 26 therein, and accommodate the passage of liquid therethrough for pressurized delivery. The pump body includes a flared section 50 that includes a frontside surface 52 adapted to be mounted against the pump housing end. The flared section includes a backside surface 54 that is adapted to accommodate placement of both the diaphragm 32 and end flange 42 thereagainst. The elongated section 18 extends axially away from the flared section 50, and has a diameter that is smaller than the flared section to facilitate its placement within the pump housing hollow chamber 46. The pump chamber 28 extends axially through the pump body from the flared section backside surface 54 to a wall section 56 that defines the end of the pump chamber.

Moving axially away from the flared section backside surface 54, the pump chamber includes a first diameter section 58 that is sized to accommodate placement of the diagram 32 therein, and a second diameter section 60 that is sized smaller than the first diameter section to both prohibit placement of the diaphragm therein and accommodate placement of the impeller vanes 38 therein. The pump chamber includes a third diameter section 62 that extends axially away from the second diameter section 60 to the wall section 56. The third diameter section 62 is sized smaller than the second diameter section 60 to both prohibit placement of the impeller vanes 38 therein and to accommodate placement of the inner magnet assembly 24 therein.

The pump body includes a liquid inlet port 64 and a liquid outlet port 66 that each extend radially through the flared section 50 from the pump chamber first and second diameter sections 58 and 60. As best illustrated in FIG. 2, the liquid inlet and outlet ports 64 and 66 are positioned adjacent one another along a top portion of the flared section 50. The liquid inlet and outlet ports facilitate liquid passage to and from the pump chamber. The pump body includes a number of holes 68 that extend axially through the flared section 50 to accommodate attachment means 69 such as studs or the like that are used to fasten the pump body to the pump housing.

Referring to FIGS. 1 and 3, the inner magnet assembly 24 comprises a cylindrical body 70 that includes a number of magnets 72 disposed therearound. The magnets are encapsulated to eliminate the potential for process liquid contamination via contact with the magnets, i.e., a potentially contaminating metallic object. The magnets 72 are designed to interact with the magnetic force produced by the outer magnet assembly 20. Both the pump body elongated section 18 and the inner magnet assembly body 70 are each designed having a wall thickness that permits such magnetic force to be transferred between the inner and outer magnet assemblies. The inner magnet assembly body 70 has an opening 74, that extends axially therethrough to accommodate its attachment with the shaft 30, and has a nose 76 at one of its axial ends to accommodate attachment with a complementary section of the impeller 26.

First and second ends 78 and 80 of the shaft 30 extend from each axial end of the inner magnet assembly 24 to both facilitate rotatable attachment of the shaft within the pump chamber 28, and facilitate attachment of the impeller 26 to the inner magnet assembly. The shaft can be of a bearing-type design (e.g., using ceramic sleeve bearings) or of a bearingless design. The first end 78 extends from an axial end of the inner magnet assembly 24 opposite from the nose 76, and is disposed within a shaft cavity 82 that extends partially through the pump chamber wall section 56. It is important to note that the shaft cavity 82 does not extend completely through the wall section to eliminate a potential liquid leak path along the shaft and out of the pump chamber. As discussed in better detail below, the second shaft end 80 is disposed within a shaft cavity 84 of the diaphragm 32.

It is desired that the shaft 30 be made from a material that is both inert to the corrosive affects of the process liquid, in the event that the process liquid is a corrosive or caustic chemical, and that will not be a source of contaminates, in the event that the process liquid is a high-purity liquid. Suitable materials for the shaft include ceramic materials when the shaft is of a bearing-type design, such as silica carbide and the like. For a bearingless design, a preferred material for forming the shaft is sapphire.

The impeller 26 is attached at one of its ends to the nose 76 of the inner magnet assembly 24. The impeller includes a central opening 86 that extends axially therethrough to accommodate the passage of the shaft 30. The impeller vanes 38 extend radially away from the impeller, are disposed within the second diameter section 60 of the pump chamber, and are designed to provide a desired pressurizing effect on the process liquid when rotated. The impeller also includes a number of liquid communication openings 88 that extend axially therethrough and that are positioned radially inwardly of the vanes. The openings 88 are spaced equal-distantly along the impeller and are designed to maintain a balance of liquid flow and liquid pressure on both sides of the impeller during rotation.

Figure 4:
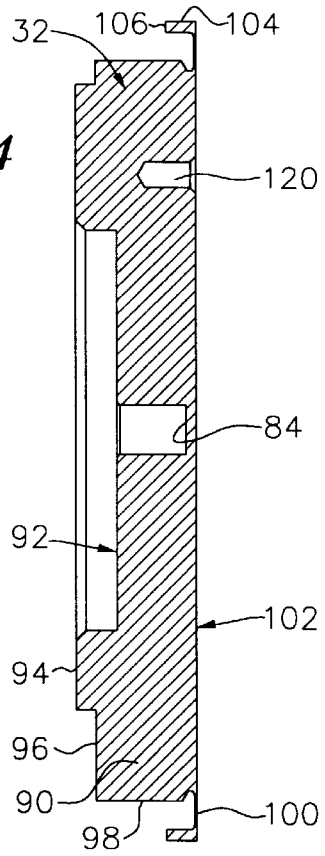
FIG. 4 is an enlarged cross-sectional side view of a pump diaphragm from the magnetically-driven centrifugal pump of FIG. 1.
Figure 5:
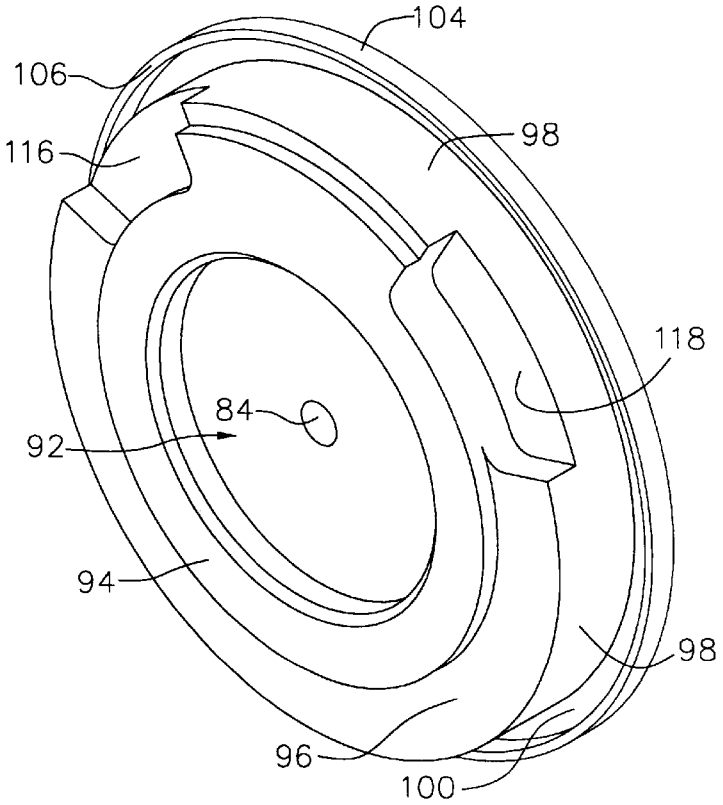
FIG. 5 is a perspective view of the pump diaphragm of FIG. 4.

Referring to FIGS. 4 to 5, the diaphragm 32 is disposed over the open end 34 of the pump body 16. The diaphragm 32 has a disc-shaped circular body 90, and comprises the shaft cavity 84 disposed centrally within its frontside surface 92. The shaft cavity 84 extends a partial depth partially into the frontside surface and does not extend completely through the diaphragm body, thereby eliminating a potential liquid leak path from the pump chamber along the shaft surface. Extending radially away from the shaft cavity, the diaphragm body includes a ridge 94 that projects axially outward a distance away from the frontside surface 92. The ridge 94 extends concentrically around the shaft cavity 84 and is designed for placement adjacent a radial edge portion of the impeller vanes 38. Moving radially away from the ridge 94, the diaphragm body 90 includes a recessed surface 96 that is recessed axially inward from the ridge 94 and that extends concentrically around the ridge to an axial edge 98 of the diaphragm body.

Extending radially away from the axial edge 98, the diaphragm body 90 includes a sleeve 100 that extends radially away from the axial edge 98 and is coplanar with a backside surface 102 of the diaphragm body. The sleeve 100 extends radially from the axial edge 98 to a terminal edge 104 of the diaphragm body. The sleeve 100 has a thin-wall construction that is designed to permit axial displacement of the diaphragm body relative to the terminal edge 104 when the diaphragm is installed between the pump body 16 and the end flange 42. The terminal edge 104 includes a tongue 106 that projects axially a distance away from the sleeve in the direction of the frontside surface 92.

The thickness of the sleeve is such that it permits the diaphragm to be axially displaceable about the terminal edge 104. Generally speaking, for an example diaphragm having a diameter of approximately 89 millimeters (3½ in., as measured across the axial edge), a sleeve having a thickness of less than about 0.12 millimeters (0.005 in.) may be too thin for use in a pump application because it may result in liquid permeation therethrough, and may not be able to withstand high pressure operation. A sleeve having a thickness of greater than about 1.5 millimeters (0.06 in.) may be too thick to accommodate a desired degree of diaphragm axial displacement. In a preferred embodiment, for a diaphragm having a diameter of approximately 89 millimeters, the sleeve has a thickness in the range of from about 0.25 to 0.65 millimeters (0.01 to 0.03 in.).

Referring back to FIG. 3, the pump diaphragm 32 is disposed within the open end 34 of the pump body 16 so that the shaft second end 80 is disposed within the shaft cavity 84, with the diaphragm frontside surface 92 adjacent to an end of the impeller. Referring to FIGS. 3 to 5, the diaphragm axial edge 98 is disposed against the pump body first diameter section 58, and maximum diaphragm axial displacement towards the impeller is limited by interaction between complementary shoulders 108 and 110 in the respective diaphragm body 90, formed by the transition between the recessed surface 96 and the ridge 94, and pump chamber 28, formed by the transition between the first and second diameter sections 58 and 60.

The diaphragm has an axial thickness designed so that, when positioned within the pump body, its backside surface 102 is generally planar with the pump body flared section backside surface 54, to facilitate placement of the diaphragm sleeve 100 onto the flared section backside surface 54. The flared section backside surface 54 includes a groove 112 disposed axially therein that is positioned concentrically around its open end to accommodate placement of the diaphragm tongue 106 therein.

Is The tongue 106 is sized having an axial length and radial width that is slightly larger than that of the groove 112 to form a tight interference fit therewith and, thereby provide a leak-tight seal between the pump body and diaphragm without the use of an O-ring seal.

It is desired that an O-ring seal between the diaphragm and pump body be avoided because: (1) an O-ring seal can be a potential source for introducing contaminate matter into a high-purity process liquid, due to the degradation of the O-ring material; (2) use of an O-ring seal can create a hold-up volume where liquid can accumulate, which is not desired when the liquid is water because of biological growth and the like that can be a potential source for introducing contaminate matter into a high-purity water process; and (3) O-ring seals formed from elastomeric materials are known to suffer from compression set after time, which can cause process liquid to leak from the pump and reduce boost or pump output pressure. The use of the tongue and groove seal eliminates such undesired O-ring seal-related contributions.

The vanes 38 of the impeller are disposed within the impeller cavity 36 that is formed within the pump chamber between the diaphragm frontside surface 92 and the pump chamber second diameter section 60. As illustrated in FIG. 5, the diaphragm body 90 includes a liquid inlet channel 116 and a liquid outlet channel 118 that are each formed along the diaphragm body frontside surface 92 and that extend radially from the recessed surface 96 and through a partial width of the of the ridge 94. The liquid inlet and outlet channels 116 and 118 are positioned along the diaphragm frontside surface in liquid flow communication with the respective inlet and outlet ports 64 and 66 through the pump body 16 to facilitate the passage of liquid to and from the impeller cavity.

Referring still to FIGS. 3 to 5, the diaphragm body 90 includes a pin cavity 120 disposed axially a partial distance within its backside surface 102 that is positioned opposite the ridge 94. The pin cavity 120 is sized to accommodate placement of a positioning pin 122 therein to prevent rotational movement of the diaphragm 32 within the pump body 16.

Referring to FIG. 3, the adjustment spacer 40 has a disc-shaped body 124 with a planar frontside surface 126 and a diameter that is approximately the same as the diameter of the diaphragm axial edge 98 to facilitate placement against the diaphragm backside surface 102 for effecting diaphragm axial displacement. The spacer 40 includes a central projection 128 that extends axially a distance away from a spacer backside surface 130 and that is sized to fit within a central opening 132 through the end flange 42. The spacer 40 includes a pin opening 134 that extends axially therethrough and that is positioned to communicate with the diaphragm pin cavity 120 to facilitate placement of the positioning pin 122 therethrough for prevent both the spacer and diaphragm from rotating vis-a-vis the pump body 16.

The end flange 42 comprises a frontside surface 136 having a recessed section 138 that extends radially a distance away from the central opening 132. The recessed section 138 is generally planar and extends radially along the frontside surface 136 to a ridge 140. The recessed section 138 includes a pin cavity 142 that is disposed a partial distance axially therein. The pin cavity 142 is positioned in communication with the pit cavities of both the adjustment spacer 40 and the diaphragm 32, and the positioning pin 122 is disposed therein to prevent the diaphragm and spacer from rotating around the pump body. The end flange recessed section 138 has a diameter that is sized to accommodate placement of the spacer therein when the end flange is attached to the pump body. The end flange ridge 140 projects outwardly a distance away from the frontside surface 136 and has a surface adapted to accommodate placement against the diaphragm sleeve 100 and the pump body backside surface 54.

The end flange 42 has a generally planar backside surface 144 that extends radially inwardly from an axial edge 146 of the end flange to a collar 148 that projects a distance axially therefrom and that is disposed concentrically around the central opening 132. The backside surface comprises a number of openings 150 that each extend axially through the end flange ridge 140. The openings 150 are positioned in communication with the holes 68 in the pump body 16 to accommodate the placement of the attachment means 69, such as bolts, studs and the like, therethrough. In an example embodiment, the attachment means 69 is in the form of studs that are placed through the end flange openings 150 and pump body holes 68, threadably attached at one end with the pump housing 12, and threadably attached at an opposite end projecting from the end flange to a nut 154. If desired, caps 156 can be placed over the nuts and stud ends projecting from the end flange. The end flange 42 and pump body 16 are attached to the pump housing by fastening the nut to the stud and tightening the nut to a desired torque. In an example embodiment, approximately six studs 69 are used to attach the end flange and pump body to the pump housing.

The adjustment knob 44 is disposed within the end flange central opening 132 and is designed to abut against the adjustment spacer central projection 128. The adjustment knob 44 is threaded within the central opening 132 to effect axial displacement of both the adjustment spacer 40 and diaphragm 32 from a position external from the pump body 16 by rotating the knob clockwise or counter clockwise. The end flange collar 148 includes a set screw 158 disposed radially therethrough to fix the adjustment knob within the end flange in a desired axial position.

It is important, for applications where the liquid being transported is a process chemical, that the wetted members of the pump (e.g., the pump body, inner magnet assembly body, impeller and diaphragm) be chemically resistant so that they will not degrade upon contact with the process chemicals and introduce contamination into chemically pure process liquids. The introduction of such contaminants into the process liquid may cause hundreds of thousands of dollars of damage to the end product manufactured using such process liquids, e.g., a batch of semiconductors undergoing treatment with such process chemicals.

In such application, it is desired that the wetted members of the pump be constructed from a fluoropolymer compound selected from the group of fluoropolymers including but not limited to polytetrafluoroethylene (PTFE), fluorinated ethylene-propylene (FEP), perfluoroalkoxy fluorocarbon resin (PFA), polychlorotrifluoroethylene (PCTFE), ethylenechlorotrifluoroethylene copolymer (ECTFE), ethylene-tetrafluoroethylene copolymer (ETFE), polyvinylidene fluoride (PVDF), polyvinyl fluoride (PVF) and the like. A particularly preferred material is Teflon® PFA or Teflon® PTFE, which are provided by DuPont Company of Wilmington, Del. Such materials are not damaged by corrosive, acidic, or caustic liquids, and do not introduce contamination into chemically pure liquids. In an example embodiment, the pump body 16, impeller 26 and diaphragm 32 are formed from Teflon® PTFE, and the inner magnet assembly body 70 is formed from Teflon® PFA.

In less demanding applications where resistance to corrosive, acidic, or caustic liquids is not of concern, the material that is used to construct the wetted members of the pump can be selected from the group of plastics, such as polyethylene, polyether ketone (PEK), polyetherether ketone (PEEK) and the like, or other suitable structural material. The pump body, impeller, and diaphragm can be made by either machine or mold process, depending example embodiment, the pump body, impeller, and diaphragm are each made by machine process. The inner magnet assembly is made by molding process because of the need to completely encapsulate the inner magnets.

The adjustment spacer 40, end flange 42 and adjustment knob 44 can each be molded or machined from any of the same materials described above. Since these pump members are not wetted by the process liquid, they can alternatively be made from other suitable structural materials such as metal, metal alloys and the like. For example, the adjustment knob 44 can be made from aluminum if desired. However, the adjustment spacer, end flange and adjustment knob can all be made from fluoropolymer materials in the event that total chemical resistance is desired. In an example embodiment, the adjustment spacer, end flange and adjustment knob are each made from PEEK. The adjustment spacer, end flange and adjustment knob can each be made by either machine or mold process, depending on the economics. In a example embodiment, the adjustment spacer, end flange and adjustment knob are each machined.

A key feature of magnetically-driven centrifugal pumps of this invention is the design of a diaphragm that is axially displaceable after pump assembly. Such an axially displaceable diaphragm is desired because it allows the spatial distance between the impeller fins and the impeller cavity to be adjusted to achieve zero tolerance to minimize bypass of pressurized liquid from the impeller cavity into the pump chamber and permit adjustment of the impeller cavity volume to provide a desired boosting or pump output pressure. Adjusting the diaphragm in this manner enables the pump to acheive both maximum pump output pressure and maximum pump efficiency. The desired boosting pressure can thereby be fine tuned or optimized by simply adjusting or rotating the adjustment knob. This feature is important because it provides a means for setting the tolerance between the impeller vanes and surrounding impeller cavity structure to zero after the pump has been assembled. The axially displacable diaphragm eliminates the problem encountered with conventional magnetically-driven centrifugal pumps of not being able to place the impeller vanes at zero tolerance, and therefore not being able to minimize pressurized liquid bypass and achieve optimum boost pressure after the pump has been assembled.

Another feature of magnetically-driven centrifugal pumps of this invention is that the magnets in the inner magnet assembly are completely enclosed or encapsulated within the inner magnet assembly body, thereby eliminating the possibility of process liquid contamination through contact with a metallic material. Still another feature is that the pump body is a one-piece construction that does not have any openings therethrough that can act as potential liquid leak paths. For example the pump body is constructed so that the shaft 30 extending through the inner magnet assembly does not extend through the body wall, thereby eliminating a potential liquid leak path. Still another feature is the elimination of O-ring seals, through the use of a tongue and groove seal between the diaphragm and pump body, thereby: (1) eliminating potential process liquid contamination via material degradation and liquid hold-up volumes; (2) eliminating related liquid leakage; and (3) maintaining optimum boost pressure.

Magnetically-driven centrifugal pumps of this invention are operated by activating the pump drive means 14 to effect rotation of the actuating member 48 and outer magnet assembly 20. The magnetic force of the rotating outer magnet assembly causes the inner magnet assembly 24 and impeller 26 to rotate, coupling the impeller to the driving means. Process liquid enters the pump chamber 28 and impeller cavity 36 via the liquid inlet port 64, where it is directed to the center of the impeller. The rotation of the impeller, clockwise rotation in an example embodiment, forces the fluid from the center of the impeller radially outwards towards the impeller vanes 38, where the plurality of vanes boosts the liquid within the impeller cavity to a desired boost or pump output pressure. The liquid pressure and centrifugal force of the impeller vanes deliver the liquid to the outlet port 66, where it is allowed to exit the pump.

The boost or pump output pressure can be adjusted or fine tuned by rotating the adjustment knob 44 to effect the axial displacement of the adjustment spacer 40 and diaphragm 32. In an example embodiment, rotating the adjustment knob in a clockwise direction will move the adjustment spacer toward the diaphragm, applying an equal force across the flexible diaphragm, thereby reducing the volume of the impeller cavity. As the volume and tolerance between the impeller vanes and diaphragm is reduced, the pressure of the liquid within the impeller cavity increases, increasing the boost or pump output pressure at the liquid outlet port 66. In the event that the diaphragm is displaced axially to the point of contacting the impeller vanes, friction between the contacting members will cause the inner and outer magnet assemblies to decouple.

Magnetically-driven centrifugal pumps of this invention are adapted for use in boosting the pressure of and transferring any low viscosity, high-purity process liquid, such as water and other chemicals including aggressive corrosive, acidic, and caustic chemicals. Pumps of this invention are designed to produce a boost or pump output pressure up to about 150 psig, and are designed for use with liquid having a temperature of less than about 100° C.

Accordingly, it is to be understood that, within the scope of the appended claims, magnetically-driven centrifugal pumps constructed according to principles of this invention may be embodied other than as specifically described herein.

It is claimed:

1. A centrifugal pump comprising:

a pump body having a pump chamber disposed therein adapted to contain a volume of liquid therein;

an impeller disposed within the pump chamber, wherein the impeller is mounted on a shaft that is rotatably disposed within the pump chamber, the impeller comprising a plurality of impeller vanes extending radially from the impeller, the impeller vanes being disposed within an impeller cavity of the pump chamber;

means for adjusting the volume of the impeller cavity after the pump has been assembled for effecting a zero tolerance fit of the impeller within the impeller cavity.

2. The centrifugal pump as recited in claim 1 wherein the means for adjusting comprises:

a diaphragm disposed within an open end of the pump body, wherein the impeller is interposed between the pump body and the diaphragm, the diaphragm having a sleeve that extends radially therefrom and that is attached to an adjacent surface of the pump body to provide a leak-tight seal with the pump body and permit axial displacement of the diaphragm relative to the seal; and means for axially displacing the diaphragm within the pump chamber that is operable from a position outside of the pump body after the pump has been assembled, and for maintaining the diaphragm in a predetermined axial position.

3. The centrifugal pump as recited in claim 2 wherein the diaphragm further comprises a tongue that projects axially away from the sleeve, and the pump body includes a groove that is disposed concentrically around the open end, and wherein the leak-tight seal between the diaphragm and pump body is formed by placement of the diaphragm tongue with the groove.

4. The centrifugal pump as recited in claim 1 further comprising:

an outer magnet assembly that comprises a plurality of magnets, wherein the outer magnet assembly is mounted at one end to a pump drive means and is disposed concentrically around the pump chamber; and an inner magnet assembly that comprises a plurality of magnets completely encapsulated within an inner magnet assembly body, wherein the inner magnet assembly is disposed concentrically around the shaft and is attached to the impeller so that rotation of the inner magnet assembly effects rotation of the impeller;

wherein the inner magnet assembly is positioned within the pump chamber so that it is magnetically coupled with the outer magnet assembly to effect rotational movement within the pump chamber.

5. A centrifugal pump comprising:

a pump body comprising:

a pump chamber disposed therein that extends from a pump body open end to a pump body closed end; and a liquid inlet port and a liquid outlet port for accommodating passage of liquid to and from the pump chamber;

an outer magnet assembly disposed concentrically around the pump chamber and attached to a drive means;

an inner magnet assembly disposed within the pump chamber and mounted to a shaft, wherein the shaft is rotatably mounted within the pump chamber;

an impeller attached to the inner magnet assembly and mounted to the shaft;

a diaphragm disposed within the open end of the pump body adjacent the impeller, wherein the diaphragm includes a sleeve that extends radially therefrom for forming a leak-tight seal with the pump body, and for facilitating axial displacement of the diaphragm relative to the pump body; and means for axially displacing the diaphragm, and fixing the axial displacement of the diaphragm, after the pump has been assembled.

6. The centrifugal pump as recited in claim 5 wherein the impeller comprises a plurality of vanes disposed within an impeller cavity of the pump chamber formed between the diaphragm and an adjacent surface of the pump body, wherein the impeller cavity has a volume that is adjustable by axial displacement of the diaphragm.

7. The centrifugal pump as recited in claim 5 wherein the diaphragm includes a tongue projecting away from the sleeve, and the pump body includes a groove that is disposed concentrically around the open end that accommodates placement of the tongue therein to form a leak-tight seal between the diaphragm and pump body.

8. The centrifugal pump as recited in claim 5 wherein the shaft is rotatably disposed at opposite ends within a shaft cavity in the pump body closed end, and within a shaft cavity in the diaphragm, wherein the shaft cavities do not extend completely through the respective pump body and diaphragm.

9. The centrifugal pump as recited in claim 5 further comprising an end flange mounted over the diaphragm and attached to the open end of the pump body, wherein a portion of the sleeve is interposed between the end flange and the pump body.

10. The centrifugal pump as recited in claim 9 wherein the means for axially displacing the diaphragm comprises a spacer that is interposed between the diaphragm and the end flange, wherein the spacer is positioned in contact with a surface of the diaphragm, wherein the end flange includes a central opening and a portion of the spacer extends through the central opening to a position outside of the pump body to enable axial displacement of the spacer and diaphragm within the pump chamber.

11. The centrifugal pump as recited in claim 10 further comprising an adjustment knob disposed within the central opening and in contact with the spacer, and means for fixing the knob into a predetermined axial position within the central opening.

12. The centrifugal pump as recited in claim 5 wherein the pump body is a one-piece construction, and wherein the inner magnet assembly, impeller, and diaphragm are each formed from a fluoropolymeric material.

13. The centrifugal pump as recited in claim 5 wherein the pump contains no O-ring seals.

14. A magnetically-driven centrifugal pump comprising:

a one-piece pump body having an open end and a closed end comprising:

a pump chamber disposed therein that extends from the pump body open end to the pump body closed end; and a liquid inlet port and a liquid outlet port for accommodating passage of liquid to and from the pump chamber;

an outer magnet assembly disposed concentrically around the pump chamber and attached to a drive means;

an inner magnet assembly comprising a plurality of magnets encapsulated within an inner magnet assembly body, the inner magnet assembly being disposed within the pump chamber and mounted to a shaft, wherein the shaft is rotatably mounted within the pump chamber;

an impeller attached to the inner magnet assembly and mounted to the shaft, the impeller having a plurality of vanes;

a diaphragm disposed within the open end of the pump body adjacent the impeller, wherein the impeller vanes are disposed within an impeller cavity formed between the diaphragm and the pump body, where the diaphragm includes a sleeve that extends radially therefrom and includes a tongue that is sized to fit within a groove disposed within the pump body open end to provide a leak-tight seal therebetween, wherein the sleeve permits axial displacement of the diaphragm within the pump body to provide a zero tolerance fit of the diaphragm against the impeller within the impeller cavity;

means for axially displacing the diaphragm within the pump body, and fixing the axial displacement of the diaphragm, after the pump has been assembled.

15. The centrifugal pump as recited in claim 14 wherein the diaphragm and pump body closed end each comprise a shaft cavity for rotatably mounting opposite ends of the shaft therein, wherein each shaft cavity extends a partial distance within wall surfaces of the respective diaphragm and pump body closed end and does not extend completely therethrough.

16. The centrifugal pump as recited in claim 14 further comprising an end flange mounted over the diaphragm and attached to the open end of the pump body, wherein a portion of the diaphragm sleeve is interposed between the end flange and the pump body.

17. The centrifugal pump as recited in claim 16 wherein the end flange includes a central opening, and wherein the means for axially displacing the diaphragm comprises:

a spacer interposed between the diaphragm and the end flange, the spacer being in contact with an adjacent surface of the diaphragm to axially displace to diaphragm within the pump body;

an adjustment knob that is disposed within the central opening and is in contact with an adjacent surface of the spacer, the adjustment knob through the central opening to a position outside of the pump body to enable axial displacement of the spacer and diaphragm.

18. The centrifugal pump as recited in claim 17 wherein the inner magnet assembly, impeller, and diaphragm are each formed from a fluoropolymeric material.

19. The centrifugal pump as recited in claim 17 wherein the end flange includes means for fixing the adjustment knob in a predetermined axial position within the central chamber.

20. The centrifugal pump as recited in claim 16 comprising a pin disposed through the spacer and into the diaphragm and end flange to prevent the spacer and diaphragm from rotating relative to the pump body.

21. An O-ringless magnetically-driven centrifugal pump comprising:

a one-piece pump body comprising:

a pump chamber disposed therein that extends from a pump body open end to a pump body closed end; and a liquid inlet port and a liquid outlet port for accommodating passage of liquid to and from the pump chamber;

an outer magnet assembly disposed concentrically around the pump chamber and attached to a drive means;

an inner magnet assembly comprising a plurality of magnets encapsulated within an inner magnet assembly body, the inner magnet assembly being disposed within the pump chamber and mounted to a shaft, wherein the shaft is rotatably mounted within the pump chamber;

an impeller attached to the inner magnet assembly and mounted to the shaft, the impeller having a plurality of vanes;

a diaphragm disposed within the open end of the pump body adjacent the impeller, wherein the impeller vanes are disposed within an impeller cavity formed between the diaphragm and the pump body, where the diaphragm includes a sleeve that extends radially therefrom and includes a tongue that is sized to fit within a groove disposed within the pump body open end to provide a leak-tight seal therebetween, wherein the sleeve permits axial displacement of the diaphragm within the pump body to provide a zero tolerance fit of the diaphragm against the impeller within the impeller cavity;

an end flange mounted over the diaphragm and attached to the open end of the pump body, a portion of the diaphragm sleeve being interposed between the end flange and pump body, the end flange having a opening extending therethrough;

a spacer interposed between the diaphragm and the end flange and in contact with an adjacent surface of the diaphragm; and an adjustment knob disposed within the end flange opening and in contact with a surface of the spacer, wherein a portion of the adjustment knob extends through the opening to a position outside of the pump body for effecting axial displacement of the diaphragm and spacer after the pump is assembled.

22. The centrifugal pump as recited in claim 21 wherein the inner magnet assembly body, impeller, and diaphragm are each formed from a fluoropolymeric material.

23. The centrifugal pump as recited in claim 22 comprising a pin disposed through the spacer and into the diaphragm and said end flange to prevent the spacer and diaphragm from rotating relative to the pump body.

24. A method for adjusting a volume of an impeller cavity within an assembled centrifugal pump comprising the steps of:

rotating an adjustment knob extending from a pump body, the adjustment knob being connected to a spacer disposed within the pump body and in contact with an axially displaceable diaphragm disposed within the pump body, to cause the diaphragm to move axially relative to a pump impeller to adjust a volume of an impeller cavity; and fixing the adjustment knob when the diaphragm is in a predetermined axial location and a determined volume is achieved.

25. The method as recited in claim 24 further comprising, during the step of rotating, axially displacing the diaphragm within the pump body, wherein such axial diaphragm movement is facilitated by a sleeve that is integral with the diaphragm and that is positioned concentrically around the diaphragm, the sleeve being attached at a peripheral edge to the pump body to form a leak-tight seal therebetween.

* * * * *